US005263823A

United States Patent [19]

Cabaret et al.

[11] Patent Number: 5,263,823

[45] Date of Patent: Nov. 23, 1993

[54] GAS TURBINE ENGINE IMPELLER HAVING AN ANNULAR COLLAR PLATFORM

[75] Inventors: Maurice J. Cabaret, Ponthierry; Christophe Champenois, Soisy s/Seine; Christophe G. J. Gourio, Redon; Gérard E. A. Jourdain, Saintry; Gilles A. Le Rumeur, Franconville; Didier Merville, Breuillet; Jean-Pierre Poitevin, Vaux le Penil; Bruno Tournaire, Rambouillet, all of France

[73] Assignee: Societe National d'Etude et de Construction de Moteurs d'Aviation (S.N.E.C.M.A.), Paris, France

[21] Appl. No.: 917,181

[22] Filed: Jul. 22, 1992

[30] Foreign Application Priority Data

Jul. 24, 1991 [FR] France ..... 91 09368

[51] Int. Cl.[5] ..... F01D 5/30

[52] U.S. Cl. ..... 416/218; 416/220 R

[58] Field of Search ..... 416/204 R, 204 A, 205, 416/207, 209, 218, 220 R

[56] References Cited

U.S. PATENT DOCUMENTS

| | | | |
|---|---|---|---|
| 922,581 | 5/1909 | Hanzlik et al. | 416/218 |
| 2,834,573 | 5/1958 | Stalker . | |
| 2,918,253 | 12/1959 | MacKay . | |
| 2,948,505 | 8/1960 | Sonder . | |
| 2,988,324 | 6/1961 | Sutters | 416/220 R |
| 3,554,668 | 1/1971 | Wagle | 416/220 R |
| 4,802,824 | 2/1989 | Gastebois et al. . | |
| 5,030,063 | 7/1991 | Berger | 416/220 R |

FOREIGN PATENT DOCUMENTS

| | | |
|---|---|---|
| 319370 | 11/1902 | France . |
| 1501492 | 11/1967 | France . |
| 2073854 | 10/1971 | France . |

*Primary Examiner*—Edward K. Look
*Assistant Examiner*—Christopher M. Verdier
*Attorney, Agent, or Firm*—Bacon & Thomas

[57] ABSTRACT

A gas turbine engine impeller having a plurality of blades attached to a rotor disk and an integral, annular collar defining openings through which the blades extend which acts as a platform extending between the adjacent blades. The annular collar is formed as an integral, annular structure and may be formed from a composite material, or other material which is resistant to high temperatures and high centrifugal forces. The annular collar defines a plurality of openings to accommodate the blade portion of the plurality of blades and to enable the blades to extend radially outwardly from the collar. The openings may be formed in the annular collar when the collar itself is formed, or may be machined therein after the collar has been fabricated.

1 Claim, 1 Drawing Sheet

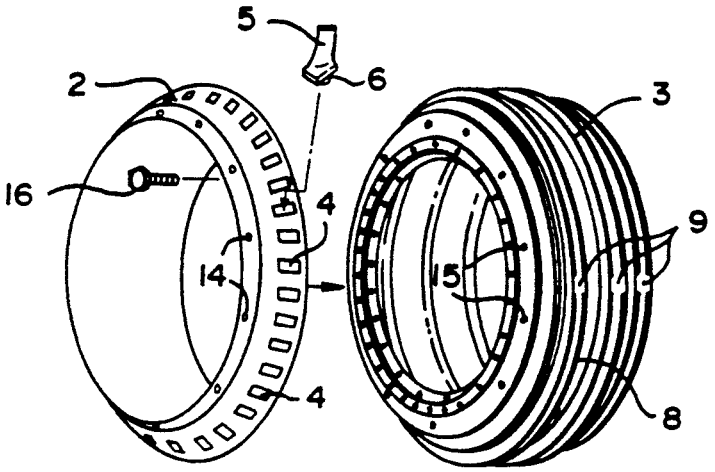
FIG. 1
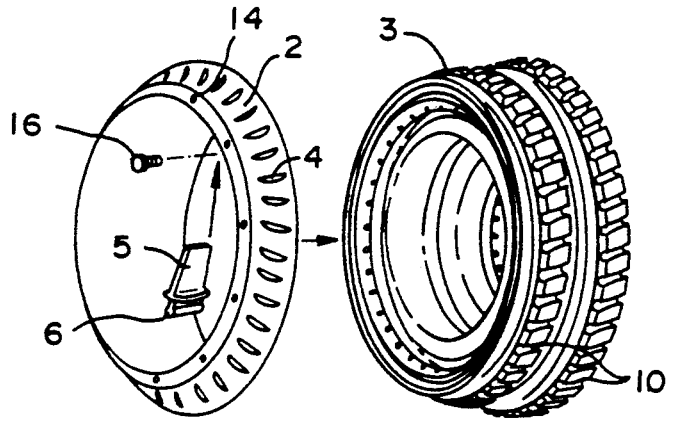
FIG. 2
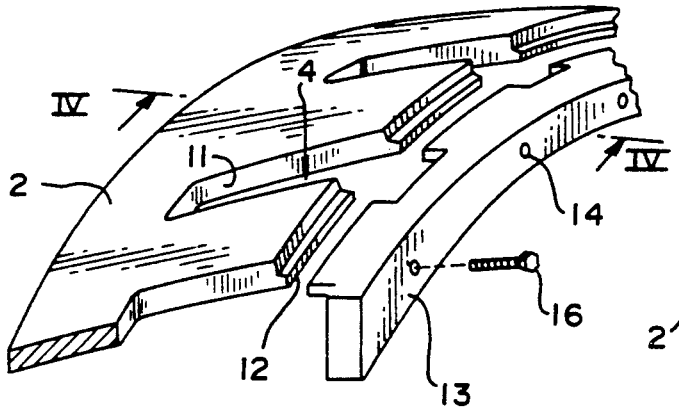
FIG. 3
FIG. 4
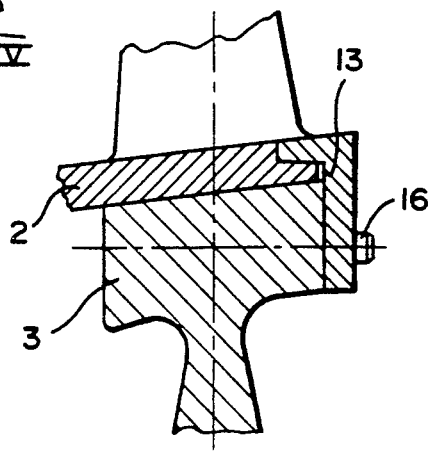

GAS TURBINE ENGINE IMPELLER HAVING AN ANNULAR COLLAR PLATFORM

BACKGROUND OF THE INVENTION

The present invention relates to a gas turbine engine impeller, more particularly such an impeller having an integral annular collar extending around the periphery of the rotor disk so as to define a platform in between the plurality of blades.

The performance of modern gas turbine engines, particularly those utilized in aeronautical applications, is increased by increasing the operational temperatures, especially those at the turbine intake, as well as increasing the rotational speeds of the turbine to increase the gas volume passing through the passages defined across the turbine blades and stators.

In order to reduce the weight of the impellers, and therefore reduce the centrifugal forces acting thereon, the blades are typically mounted on rotor disks having comparatively small diameters. The weight is further reduced by fabricating the disks and blades from composite materials, or other types of materials which are resistant to high temperatures and centrifugal forces.

For reasons of manufacturing economy, the composite blades are typically made without platforms such that they have an aerodynamic profile extending substantially from their tip to their root. Once the blades are assembled to the rotor disk, platforms must be separately attached thereto. The platforms define the inner boundary of the passage through which the turbine gasses pass. The platforms also have a diameter which generally exceeds the diameter of the rotor disk in order to avoid contact between the turbine gases and the rotor disk to minimize the turbulence of the gases passing through the turbine. The platforms also serve to reduce the heat transfer from the turbine gases to the rotor disk, thereby protecting it from excessively high temperatures.

In known types of gas turbine engine impellers, the platform comprises a plurality of separate and discrete elements which are assembled to form a platform ring, the elements being also separate from the blades and affixed to the rotor disks.

U.S. Pat. No. 2,834,573 discloses a rotor construction wherein the platform ring extends between the blades and is formed from a plurality of individual, separate ring segments. Each segment extends between a pair of adjacent turbine blades.

French Patent 1,501,492 discloses a compressor impeller wherein the blades are formed without platforms and wherein the platform is formed by a plurality of individual segments extending between adjacent blades and attached to the rotor disk.

French Patent 2,073,854 describes an impeller rotor in which segments extending between adjacent blades provide mechanical damping to minimize blade vibration, but also serve as gas flow platforms. Again, these segments are attached to the rotor disk adjacent to the blade roots.

U.S. Pat. No. 4,802,824 discloses a turbine impeller wherein the blade roots are held in place within cavities defined by the rotor disk by a plurality of wedge-shaped segments which also act as platforms.

In all of the structures noted above, the separate, individual segments which constitute the platform ring must be rigidly affixed to the rotor disk because of the high centrifugal forces acting on them during the high speed operation of the gas turbine engine. The large number of separate elements increases the time required to assemble the gas turbine impeller, thereby increasing the manufacturing costs. Similarly, a great amount of time is required when the impeller must be disassembled for repairs or routine maintenance.

SUMMARY OF THE INVENTION

A gas turbine engine impeller is disclosed having a plurality of blades attached to a rotor disk and an integral, annular collar defining openings through which the blades extend which acts as a platform extending between the adjacent blades. The annular collar is formed as an integral, annular structure and may be formed from a composite material, or other material which is resistant to high temperatures and high centrifugal forces.

The annular collar defines a plurality of openings to accommodate the blade portion of the plurality of blades and to enable the blades to extend radially outwardly from the collar. The openings may be formed in the annular collar when the collar itself is formed, or may be machined therein after the collar has been fabricated.

The annular collar enables the weight of the impeller to be reduced and, at the same time, simplifies the assembly and disassembly of the impeller structure. The collar may be applicable to all types of systems for attaching the blades to the rotor disk, such as "hammer" type fastening systems and pinned type fastening systems.

BRIEF DESCRIPTION OF THE DRAWINGS

FIG. 1 is an exploded, perspective view of the annular collar according to the present invention utilized with a rotor disk having a first type of blade fastening system.

FIG. 2 is an exploded, perspective view of a gas turbine engine impeller utilizing the annular collar according to the present invention with a rotor disk having a second type of blade fastening system.

FIG. 3 is a partial, perspective, exploded view illustrating a second embodiment of the annular collar according to the present invention.

FIG. 4 is a cross-sectional view taken along line IV—IV in FIG. 3.

DETAILED DESCRIPTION OF THE PREFERRED EMBODIMENTS

The figures illustrate an integral, annular collar 2, which may be made of composite materials, which can be positioned on and located co-axially with the gas turbine engine rotor disk 3 so as to form a blade platform defining the inner boundary of the gas flow passage through the turbine. The annular collar 2 defines a plurality of openings 4 which enables the blade portion of blades 5 to extend radially outwardly from the annular collar 2, when the device is assembled. The blade roots 6 extend inwardly of the annular collar 2 and are attached to the periphery of the rotor disk 3 by known means. The openings 4 may be formed in the annular collar when the collar is fabricated, or may be subsequently machined through the collar after it has been fabricated. Since the blades may be made of composite material, their blade portion extends substantially along their entire length and the blades are thus formed without integral platforms.

FIG. 1 illustrates the annular collar according to this invention utilized with an impeller in which the blades 5 are attached to the rotor disk 3 by a "hammer" type fastening system. In this system, annular grooves 8 are formed in the periphery of the rotor disk 3 such that it defines a cavity which receives the root portions 6 of the blades 5. The grooves 8 define an insertion window 9 through which the blade root portions 6 may be inserted into the grooves 8. In order to carry out the assembly of this device, the integral annular collar 2 is placed loosely over the rotor disk 3 and a first blade is inserted through one of the openings 4 which is in alignment with the insertion window 9. Once the root portion has been inserted into the groove 8, the blade 5 and the collar 2 are turned circumferentially with respect to the rotor disk 3 so as to bring an adjacent opening 4 into alignment with the insertion window 9. This sequence is continued until all of the blades 5 have been inserted into the groove 8. At this point, the integral annular collar 2 is fixedly attached to the rotor disk 3 by fasteners 16 extending through openings 14 and 15. Obviously, the location should be such that none of the blades 5 is in alignment with the insertion window 9.

FIG. 2 illustrates an engine impeller similar to that in FIG. 1, but one which utilizes a pin-type system to fasten the rotor blades to the rotor disk. Rotor disk 3 has a periphery which defines a plurality of axial cavities 10 adapted to receive the root portions 6 of turbine blades. In this type of system, all of the blade portions are inserted through the annular collar 2 from the inside, as illustrated in FIG. 2. Once all of the blades 5 have been assembled to collar 2 such that their blade portions extend radially outwardly from the collar, the assembly is installed on the rotor disk 3 by axially moving the assembly onto the disk 3 such that the root portions 6 engage axial cavities 10. The, annular collar 2 is fixedly attached to the rotor disk 3 as in FIG. 1.

A second embodiment of the annular collar is illustrated in FIGS. 3 and 4. In this embodiment, the annular collar 2 defines a plurality of slots 11 which open through edge portion 12 so as to facilitate the assembly of the impeller. Using this annular collar embodiment, the blades 5 are inserted into their respective cavities in the rotor disk 3 and annular collar 2 may be axially moved into position. The assembly is attached to the rotor disk 3 by ring 13 which engages edge 12, extends across the open ends of the slots 11 and may be attached to the rotor disk 3 by fasteners 16 extending through holes 14.

Although the integrated annular collar has been described in conjunction with only a single blade stage, it is to be understood that it may be axially lengthened so as to encompass several blade stages of the impeller.

The foregoing description is provided for illustrative purposes only and should not be construed as in any way limiting this invention, the scope of which is defined solely by the appended claims.

We claim:

1. A gas turbine engine impeller comprising:

a) a plurality of blades, each having a blade portion and a root portion;

b) a rotor disk having a peripheral surface adapted to receive the root portions of the plurality of the blades so as to attach the blades to the rotor disk;

c) an integral annular collar defining a plurality of openings so as to allow the blade portion of the plurality of blades to extend therethrough wherein the integral annular collar comprises an edge portion and wherein the plurality of openings each comprise a slot opening through the edge portion of the integral annular collar; and, d) attaching means to fixedly attach the integral annular collar to the rotor disk such that the integral annular collar defines a platform between the plurality of blades; wherein the attaching means comprises:

i) a ring member engaging the edge portion of the integral annular collar so as to extend across the open end of the slots defined by the annular collar; and, ii) fastening means to fasten the ring member to the rotor disk.

* * * * *